United States Patent [19]

Tajima

[11] Patent Number: 4,793,605

[45] Date of Patent: Dec. 27, 1988

[54] PAPER DETECTOR OF PRINTER

[75] Inventor: Akio Tajima, Tokyo, Japan

[73] Assignee: Seikosha Co., Ltd., Tokyo, Japan

[21] Appl. No.: 913,698

[22] Filed: Sep. 30, 1986

[30] Foreign Application Priority Data

Oct. 7, 1985 [JP] Japan ..... 60-222996

[51] Int. Cl.[4] ..... B65H 5/26

[52] U.S. Cl. ..... 271/9; 271/265; 271/227; 250/572; 400/708

[58] Field of Search ..... 271/258, 265; 250/571, 250/572; 400/708, 708.1, 605; 271/9, 227, 228

[56] References Cited

U.S. PATENT DOCUMENTS 4,424,964 1/1984 Kikuchi et al. ..... 271/9
4,579,471 4/1986 Hendrischk ..... 400/605

FOREIGN PATENT DOCUMENTS 55-66432 5/1980 Japan ..... 271/9
59-123693 7/1984 Japan ..... 400/708

OTHER PUBLICATIONS

Hunt, IBM Tech. Disclosure Bulletin, Sep. 1974, vol. 17, No. 4.

*Primary Examiner*—H. Grant Skaggs
*Attorney, Agent, or Firm*—Bruce L. Adams; Van C. Wilks

[57] ABSTRACT

A paper detector for a printer of the type having a printer head, a platen and two paper guide paths for guiding recording paper to a position between the printer head and the platen. The paper detector comprises a reflection-type photo sensor comprised of a light-emitting element and a light-receiving element for detecting the presence of recording paper inserted in one of the two guide paths. A pivotable detecting lever is pivoted by the recording paper when the recording paper is inserted in the other of the two guide paths, and the pivotal movement of the detecting lever, in turn, displaces a reflecting plate to a position covering the photo sensor so that light emitted from the light-emitting element is reflected by the reflecting plate to the light-receiving element thereby detecting the presence of paper in the other guide path.

6 Claims, 3 Drawing Sheets

PAPER DETECTOR OF PRINTER

BACKGROUND OF THE INVENTION (1) Field of the Invention

This invention relates to a paper detector for a printer provided with two paths for guiding recording paper (hereinafter referred to simply as the paper) between a printer head and a platen.

(2) Background Information

One conventional type of printer having two guide paths for guiding the paper between a printer head and a platen where the printing occurs is equipped with two paper detectors, one provided in each of the respective guide paths, such as photo sensors or micro switches.

Consequently, because the two separate detectors are provided, one in each of the respective guide paths, the configuration is complicated, the assembly work is troublesome, and hence the manufacturing cost is relatively high.

SUMMARY OF THE INVENTION

Accordingly, it is an object of the present invention to provide a single paper detector adapted for use with a printer having two guide paths for guiding the paper, the single detector being capable of detecting the presence/absence (i.e. presence or absence) of the paper in either guide path.

The present invention is characterized in that a reflection type photo sensor is provided which is composed of a light emitting element for emitting light toward the paper being inserted in one guide path and a light receiving element for receiving light reflected from the paper. Additionally a detecting lever is provided which is displaced by the paper when it is inserted in the other guide path, and the displaced detecting lever positions a reflecting plate to a position to reflect light back into the photo sensor in response to the displacement of the detecting lever.

Therefore, the one photo sensor which is positioned so as to face a first guide path detects whether the paper is inserted in the first guide path or not, and when paper is inserted in the other guide path, a reflecting plate is displaced into a position in front of the photo sensor owing to cooperating displacement of a detecting lever. The light coming from the photo sensor is thus reflected by the reflecting plate, and through receipt of the thus reflected light by the photo sensor the presence/absence of paper in the other guide path is detected.

DETAILED DESCRIPTION OF PREFERRED EMBODIMENTS

An embodiment of the present invention will now be described with reference to the drawings.

Figure 1:
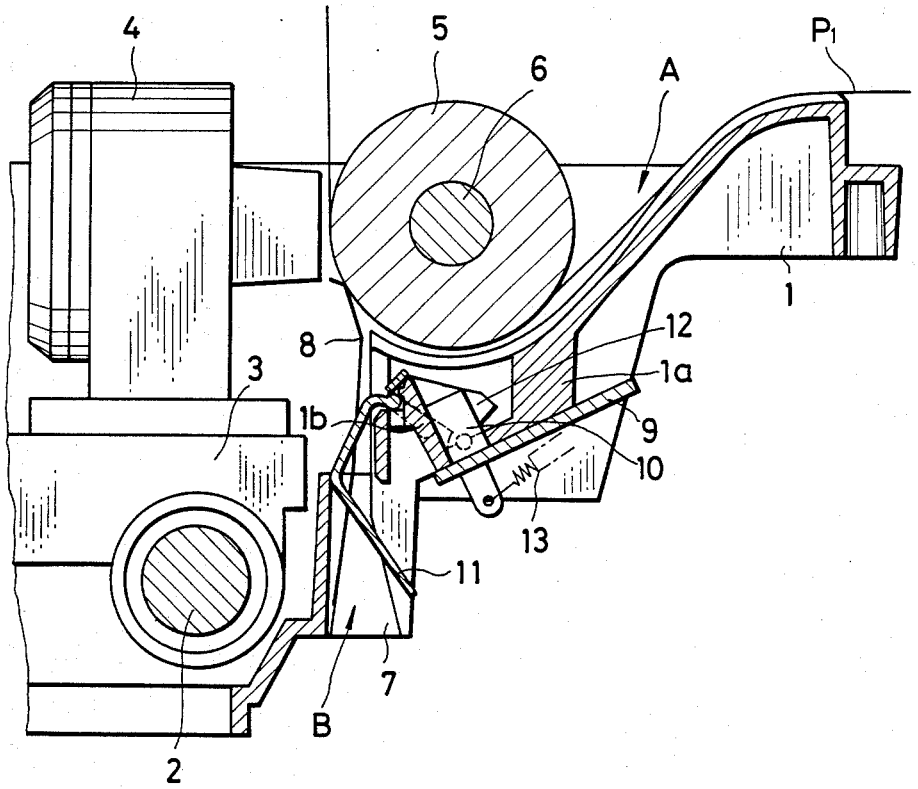
FIG. 1 is a sectional view of a printer when a first paper guide path is in use.

In FIG. 1, between the side faces of a frame body 1 of a printer is mounted a guide shaft 2. A carriage 3 carrying printer head 4 is reciprocatingly movable along this guide shaft toward and away from the plane of the drawing. In front of the printer head 4, a platen 5 is rotatably supported by the frame body 1 via a shaft 6.

Within the frame body 1, there are provided a first guide path A which starts from the right-hand side of FIG. 1 and passes under the platen 5 and then between platen 5 and the printer head 4, and a second guide path B which starts from a tapered paper insertion inlet 7 opened in the lower portion of the frame body, goes upward, and after being guided by a paper holding spring 8, passes between the platen 5 and the printer head 4.

On the underside of the frame body 1 is integrally formed a support frame 1*a*. On this support frame is secured a circuit substrate 9, and at a predetermined spot on the upper surface of this substrate is mounted a photo sensor 10. The photo sensor 10 detects the presence/absence of the paper P1 being inserted in the first guide path A by detecting paper at that portion of path A on the lower side of the platen 5 by causing its light emitting element 10*a* to emit light toward the paper and its light receiving element 10*b* to receive reflected light (see FIGS. 1 and 2).

The configuration of the second guide path B is made in such a manner that a detecting lever 11 is provided slightly above the paper insertion inlet 7 with part of lever 11 projecting into the second guide path B as shown in FIG. 1. Bearing portions 11*a*, 11*a* of detecting lever 11 are pivotably mounted and thus swingably supported by a bearing frame 1*b* (see FIG. 1) formed in the support frame 1*a* as shown in FIG. 1 and FIG. 2, and these bearing portions have pushing segments 11*b*, 11*b* formed integrally therewith at their respective edges.

The configuration of a reflecting plate 12 which is pivotally mounted and movable by contact with pushing segments 11*b*, 11*b* will now be described.

Figure 2:
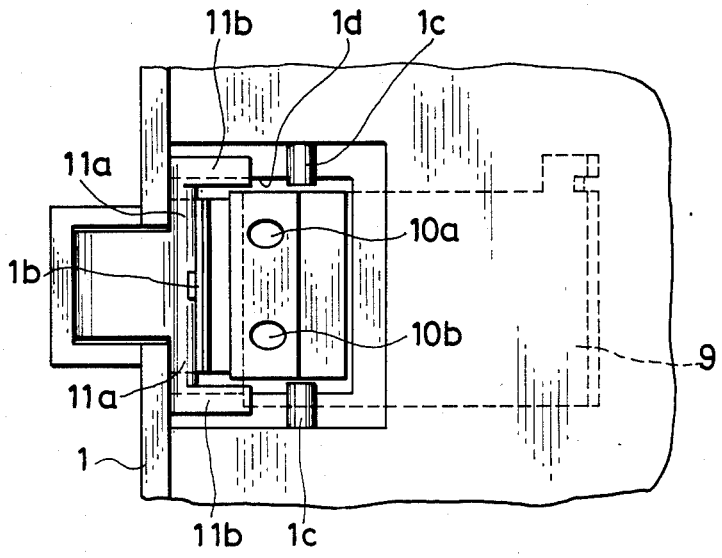
FIG. 2 is an upper view of a photo sensor and detecting lever with the reflecting plate omitted.
Figure 3:
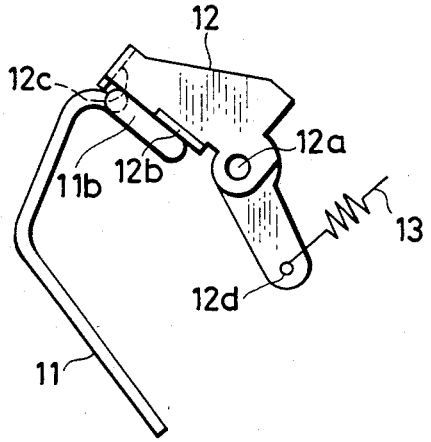
FIG. 3 is a front view showing the relation between the reflecting plate and the detecting lever.
Figure 4:
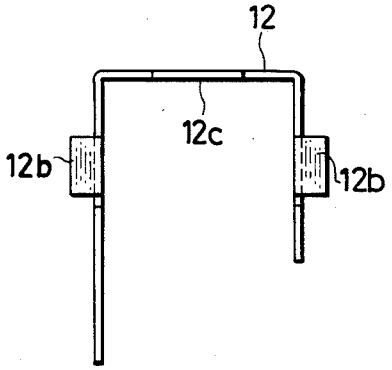
FIG. 4 is a left-hand side view of the reflecting plate.

As shown in FIG. 2, the frame body 1 has shaft supports 1*c*, 1*c* provided in mutually opposed relation taking the photo sensor 10 as the center, and although omitted from FIG. 2, the reflecting plate 12 is pivotally mounted and thus swingably supported within a cut away hole 1*d* by a shaft journaled in shaft supports 1*c*, 1*c*. The configuration of the reflecting plate 12 is, as shown in FIGS. 3 and 4, substantially U-shaped as a whole and has a bearing hole 12*a* formed in each side of its central portion (FIG. 3), so as to receive a shaft journaled in shaft supports 1*c*, 1*c*. Reflecting plate 12 has parallel-extending side segments having tongue pieces 12*b*, 12*b* formed integrally therewith projecting outward (see FIG. 4), and these tongue pieces are in contact with the pushing segments 11*b* of the detecting lever 11. The inner surface of the head section (upper section) of reflecting plate 12 orthogonal to its side surfaces forms a reflecting surface 12*c*. The lower end of the longer side segment has a lock hole 12*d* to which one end of a spring 13 is coupled, so that the reflecting plate is always urged by the resultingly applied weak spring force counterclockwise about the shaft supports 1*c*.

Accordingly, in one mode of operation when the paper P1 is supplied by the use of the first guide path A so that it is fed between the printer head 4 and the platen 5, as shown in FIG. 1, the presence/absence of the paper being inserted below the platen 5 is detected by the reflection type photo sensor 10.

Figure 5:
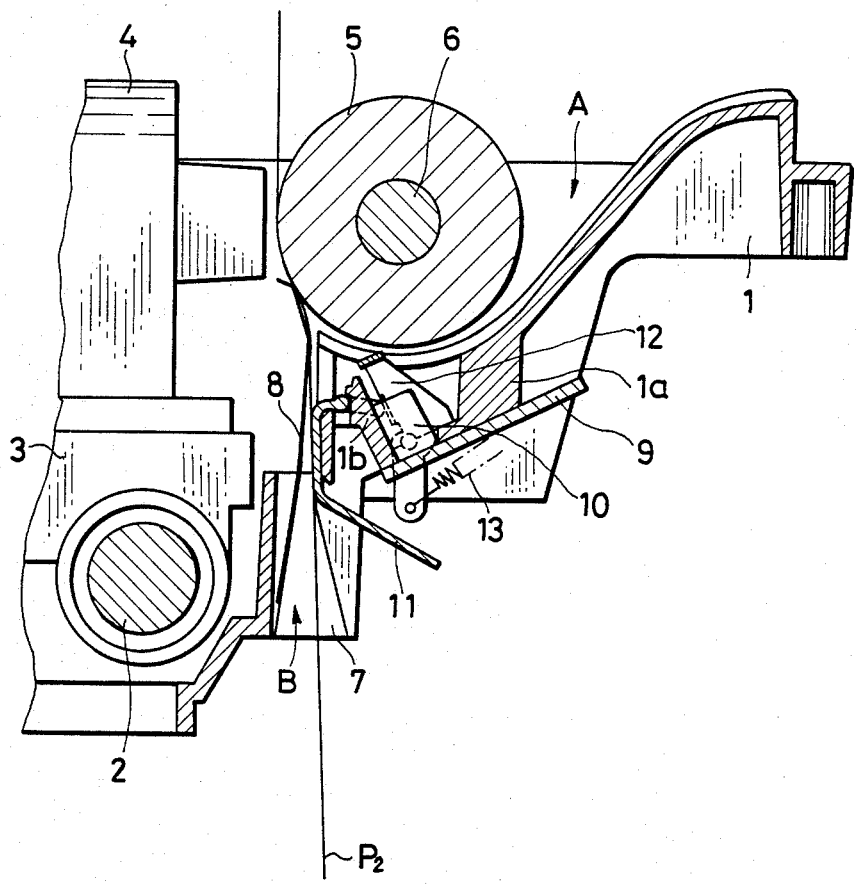
FIG. 5 is a sectional view of the printer when a second paper guide path is in use.

Correspondingly in another mode of operation, when paper P2 is inserted in the second guide path B, as shown in FIG. 5, as this paper is fed upward through the insertion inlet 7, the paper P2 slidably engages the detecting lever 11 and swings the lever 11 counterclockwise about its bearing portions 11*a*. As a result, the pushing segments 11*b* of the detecting lever 11 swing counterclockwise and push the tongue pieces 12*b* of the reflecting plate 12, and hence the reflecting plate is rotated clockwise about the shaft supports 1*c* in opposition to the spring force of the spring 13. Consequently, the reflecting surface 12*c* of the reflecting plate 12 comes to a position covering the front of the photo sensor 10, so that the light emitted from the light emitting element 10*a* of the photo sensor is reflected by reflecting surface 12*c* and detected by the light receiving element 10*b*, whereby the presence/absence of the paper P2 can be detected. Of course, when the paper P2 is not inserted through the insertion inlet 7, the reflecting plate 12 is returned to its original position owing to the spring force of the spring 13, and hence the photo sensor 10 would detect the paper P1 if inserted in the first guide path A.

Alternately, the reflecting plate 12 may be made so that it returns to its original position responsive to its weight moment.

In printers of the type having two guide paths, since the present invention provides the foregoing arrangement, it is possible to detect the recording paper existing in either guide path by one detecting means, thus, the configuration is simplified and the manufacturing cost is lowered appreciably.

What is claimed is:

1. A paper detector for a printer having two separate guide paths for guiding recording paper to a position between a printer head and a platen, comprising:

a reflection type photo sensor for detecting the presence/absence of the recording paper inserted in one of said guide paths, a displaceable detecting lever positioned so as to be displaced by the recording paper in response to insertion of said paper in the other of said guide paths, and a displaceable reflecting plate displaced to a position covering the front of said photo sensor in response to the displacement of said detecting lever.

2. A paper detector for use with an apparatus having two paper guide paths for guiding paper therealong, the paper detector comprising; detecting means normally operable in a first mode for detecting the presence of paper in one of the two guide paths and operable when switched to a second mode for detecting the presence of paper in the other of the two guide paths; and means mechanically responsive to the insertion of paper in said other guide path for switching the detecting means from the first to the second mode to thereby enable the detecting means to detect the presence of paper in said other guide path.

3. A paper detector for use with an apparatus having two paper guide paths for guiding paper therealong, the paper detector comprising: detecting means normally operable in a first mode for detecting the presence of paper in one of the two guide paths and operable when switched to a second mode for detecting the presence of paper in the other of the two guide paths, the detecting means including light-emitting means for emitting and directing light toward a spot along said one guide path such that when the detecting means is in the first mode the light impinges on and is reflected by paper present in said one guide path, and light-receiving means positioned to receive the reflected light; and means responsive to the presence of paper in said other guide path for switching the detecting means from the first to the second mode to thereby enable the detecting means to detect the presence of paper in said other guide path, the means for switching the detecting means comprising means operative in the absence of paper in said other guide path for enabling light reflected by paper present in said one guide path to reach the light-receiving means and operative in response to the presence of paper in said other guide path for intercepting the light emitted by the light-emitting means and directing the intercepted light to the light-receiving means.

4. A paper detector according to claim 3; wherein the means for switching the detecting means includes displaceable reflecting means displaceable into and out of the path of light emitted by the light-emitting means in response to the presence and absense of paper in said other guide path for intercepting the emitted light and reflecting the same to the light-receiving means when paper is present in said other guide path.

5. A paper detector according to claim 4; wherein the reflecting means includes a pivotable lever pivotable between first and second positions, means for biasing the lever into the first position in the absence of paper in said other guide path and permitting the lever to pivot to the second position in response to the presence of paper in said other guide path, and a reflecting member connected to the lever for reflecting the emitted light to the light-receiving means when the lever is in the second position.

6. A paper detector for detecting the presence of recording paper in a printer having two paper guide paths for guiding paper to a position between a printer head and a platen, the paper detector comprising:

reflection-type photo sensor means for detecting the presence of recording paper inserted in one of said two guide paths, said photo sensor means comprising a light-emitting element and a light-receiving element;

a reflecting plate having parallel extending side segments, and tongue pieces integral with said side segments;

a detecting lever with multiple pushing segments carried thereby;

and means mounting said detecting lever to undergo displacement by the recording paper when said paper is inserted in one of said two guide paths to cause said pushing segments to push on said tongue pieces and thereby move said reflecting plate to a position covering the front of said photo sensor means so that light emitted from said light-emitting element is reflected back to said light-receiving element.

* * * * *